US007477212B2

(12) United States Patent
Choi

(10) Patent No.: US 7,477,212 B2
(45) Date of Patent: Jan. 13, 2009

(54) APPARATUS FOR DRIVING A PLASMA DISPLAY PANEL

(75) Inventor: Hak-Ki Choi, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 225 days.

(21) Appl. No.: 11/337,466

(22) Filed: Jan. 24, 2006

(65) Prior Publication Data

US 2006/0164372 A1 Jul. 27, 2006

(30) Foreign Application Priority Data

Jan. 26, 2005 (KR) ..... 10-2005-0007218

(51) Int. Cl.
*G09G 3/28* (2006.01)

(52) U.S. Cl. ..... 345/60; 345/61; 345/62; 345/66; 345/67; 345/68

(58) Field of Classification Search ..... 345/60–68, 345/90–100, 204–215, 37–41; 315/169.1–169.4
See application file for complete search history.

(56) References Cited

U.S. PATENT DOCUMENTS 5,081,400 A * 1/1992 Weber et al. ..... 315/169.4
2004/0207619 A1* 10/2004 Cho et al. ..... 345/212
2006/0250327 A1* 11/2006 Vossen et al. ..... 345/60

FOREIGN PATENT DOCUMENTS

| | | | |
|---|---|---|---|
| CN | 1313582 | | 9/2001 |
| CN | 1337036 | | 2/2002 |
| KR | 2001-0101400 | A1 | 11/2001 |
| KR | 1020030046849 | A1 | 6/2003 |

OTHER PUBLICATIONS

Chinese Office Action dated Jul. 18, 2008.

* cited by examiner

*Primary Examiner*—Vijay Shankar
(74) *Attorney, Agent, or Firm*—H. C. Park & Associates, PLC

(57) ABSTRACT

Provided is a PDP driving apparatus for reducing electromagnetic interference (EMI) generated during operation of a PDP. The PDP driving apparatus drives a PDP with X electrodes and Y electrodes arranged parallel to each other, and Address electrodes arranged to cross with the X electrodes and the Y electrodes to form discharge cells. The PDP driving apparatus includes a frequency lowering unit coupled between an X electrode and a ground terminal or between a Y electrode and a ground terminal. The frequency lowering unit includes a capacitor with capacitance between about 1 nF and about 2 nF, and lowers a resonance frequency caused by parasitic capacitance and inductance components of the PDP driving apparatus.

14 Claims, 6 Drawing Sheets

APPARATUS FOR DRIVING A PLASMA DISPLAY PANEL

CROSS REFERENCE TO RELATED APPLICATION

This application claims priority to and the benefit of Korean Patent Application No. 10-2005-0007218, filed on Jan. 26, 2005, which is hereby incorporated by reference for all purposes as if fully set forth herein.

BACKGROUND OF THE INVENTION

1. Field of the Invention

The present invention relates to an apparatus for driving a display panel, and more particularly, to an apparatus for driving a plasma display panel (PDP).

2. Discussion of the Background

In a plasma display panel (PDP), which is a type of flat panel display, a discharge gas is filled between two substrates, on which a plurality of electrodes is formed on each substrate. A discharge voltage is applied between two of the electrodes, and phosphors arranged in a pattern are excited by ultraviolet light generated by the discharge voltage, thereby displaying a desired image.

By applying driving signals to the electrodes, a discharge is generated in discharge cells formed by the electrodes. First, a driving signal is applied to electrodes corresponding to selected discharge cells to be turned on. Then, a driving signal, called a sustain pulse, is applied to the selected discharge cells, so that a sustain discharge is generated in the selected discharge cells. The sustain pulse alternates between two voltages, a first voltage and a second voltage, which may be a ground voltage, and the brightness of the light emitted from each discharge cell is determined according to the number of applied cycles of the sustain pulse.

Since the sustain pulse applied to the electrodes of a PDP alternates between the predetermined voltage and the ground voltage as described above, a peak current occurs in the circuitry of the PDP. The peak current occurs when the sustain discharge is generated in the discharge cells of the PDP, and the peak current generates an electromagnetic wave within the PDP.

Generally, the electromagnetic wave intensity increases as the duration of the sustain pulse increases, as the rate of voltage change with respect to time increases, and as the rate of current change with respect to time increases. Furthermore, when a sustain pulse is applied to selected discharge cells while the PDP is generating a sustain discharge, large changes occur in current and voltage with respect to time, and the intensity of the electromagnetic wave can increase. An electromagnetic wave generated in the circuitry of the PDP has a detrimental effect on the PDP driving apparatus and on the PDP.

For these reasons, efforts have been made to minimize the generation of the electromagnetic wave. For example, a method has been developed which varies the frequency of the sustain pulse. However, the method may result in an unstable sustain discharge, which can decrease brightness of emitted light. Another method connects a capacitor between the terminals of switches that apply voltages to the PDP, thereby removing high-frequency noise generated when the switches perform the switching operations and avoiding electromagnetic interference (EMI). However, with this method, output waveforms can be distorted. Additionally, the heat generation by the switches can increase if the total capacitance of the added capacitors is large. Finally, since capacitors must be connected to the switches, this method can result in high manufacturing cost.

SUMMARY OF THE INVENTION

This invention provides an apparatus for driving a display panel, where the apparatus is capable of reducing electromagnetic interference (EMI) of the display panel.

Additional features of the invention will be set forth in the description which follows, and in part will be apparent from the description, or may be learned by practice of the invention.

The present invention discloses an apparatus for driving a plasma display panel (PDP). The PDP includes a plurality of X electrodes and a plurality of Y electrodes arranged parallel to each other and a plurality of Address electrodes arranged to cross with the plurality of X electrodes and the plurality of Y electrodes to define discharge cells. The apparatus for driving the PDP includes a sustain pulse applying unit including a first voltage applying unit for outputting a first voltage to one X electrode of the plurality of X electrodes and a ground voltage applying unit for outputting a ground voltage to the X electrode, a second voltage applying unit outputting a second voltage to the X electrode, and a frequency lowering unit coupled between the X electrode and a ground terminal and lowering a resonance frequency caused by parasitic capacitance and inductance components of the sustain pulse applying unit and the second voltage applying unit.

The present invention also discloses an apparatus for driving a plasma display panel (PDP). The PDP including a plurality of X electrodes and a plurality of Y electrodes arranged parallel to each other and a plurality of Address electrodes arranged to cross with the plurality of X electrodes and the plurality of Y electrodes to define discharge cells. The apparatus for driving the PDP includes a sustain pulse applying unit including a first voltage applying unit for outputting a first voltage to a first node and a ground voltage applying unit for outputting a ground voltage to the first node, a first switching unit coupled between the first node and a second node and including a sixth switching device, a third voltage applying unit gradually increasing the first voltage to a third voltage and outputting the third voltage to the second node, a fourth voltage applying unit gradually decreasing the first voltage to a fourth voltage and outputting the fourth voltage to the second node, a scan switching unit including a first scan switching device and a second scan switching device coupled in series with each other, wherein one of the plurality of Y electrodes is coupled between the first scan switching device and the second switching device, a fifth voltage applying unit coupled with the first scan switching device and outputting a fifth voltage, a sixth voltage applying unit coupled between the second node and the second scan switching device and outputting a sixth voltage, and a frequency lowering unit coupled between the second scan switching device and a ground terminal, and lowering a resonance frequency caused by parasitic capacitance and inductance components of the sustain pulse applying unit, the first switching unit, the scan switching unit, the third voltage is applying unit, the fourth voltage applying unit, the fifth voltage applying unit, and the sixth voltage applying unit.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
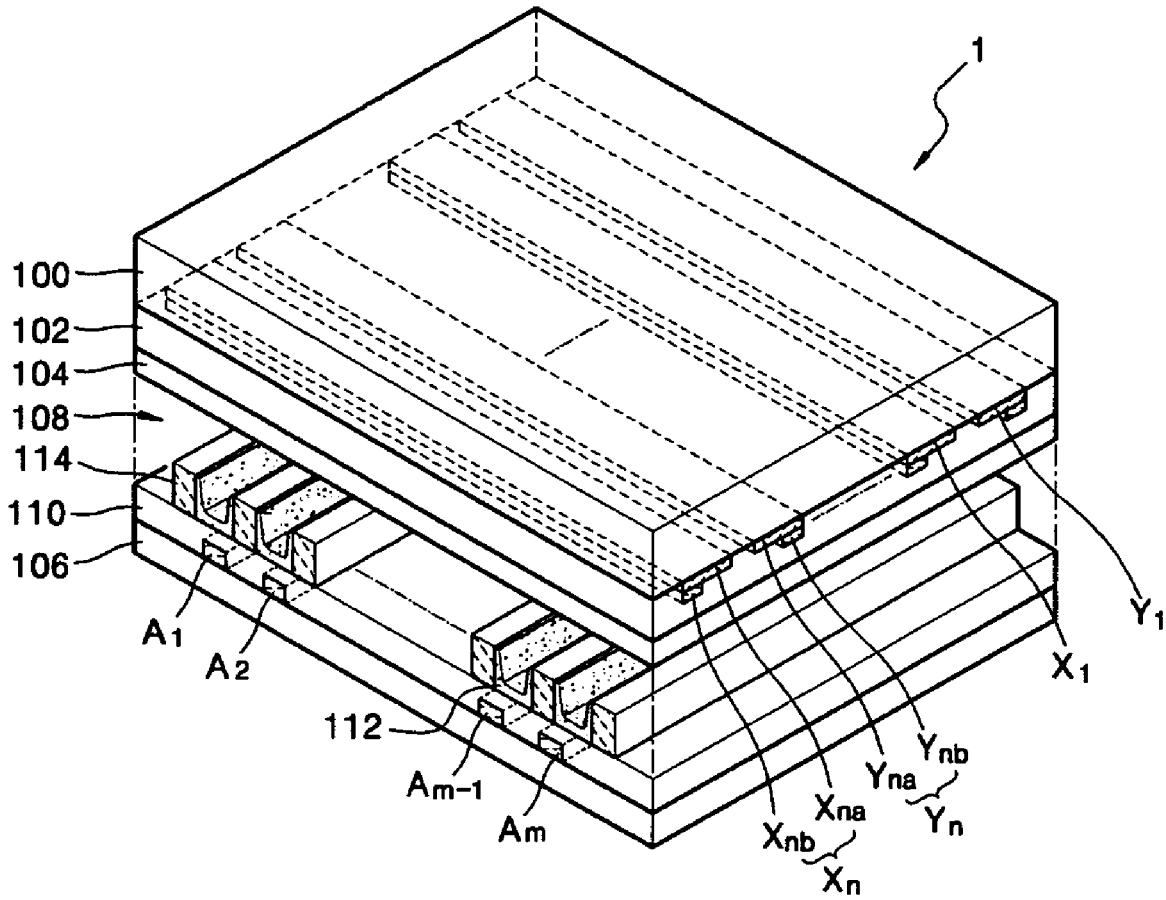
FIG. 1 shows a perspective view of a conventional plasma display panel (PDP) driven by a PDP driving apparatus.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

FIG. 1 shows a perspective view of a conventional plasma display panel (PDP) driven by a PDP driving apparatus.

Referring to FIG. 1, Address electrodes $A_1$ through $A_m$, first dielectric layer 102 and second dielectric layer 110, Y electrodes $Y_1$ through $Y_n$, X electrodes $X_1$ through $X_n$, phosphor layers 112, barrier ribs 114, and a MgO protection layer 104 are provided between a first substrate 100 and a second substrate 106 of a PDP.

The Address electrodes $A_1$ through $A_m$ are formed in a predetermined pattern on the second substrate 106 facing the first substrate 100. The second dielectric layer 110 covers the Address electrodes $A_1$ through $A_m$. The barrier ribs 114 can be formed parallel to the Address electrodes $A_1$ through $A_m$ on the second dielectric layer 110. The barrier ribs 114 partition the discharge cells and prevent optical interference between the respective discharge cells. The phosphor layers 112 are formed between the barrier ribs 114 on the second dielectric layer 110 over the Address electrodes $A_1$ through $A_m$. A red-emitting phosphor layer, a green-emitting phosphor layer, and a blue-emitting phosphor layer can be sequentially disposed.

The X electrodes $X_1$ through $X_n$ and Y electrodes $Y_1$ through $Y_n$ are formed in a predetermined pattern on the first substrate 100 facing the second substrate 106, in a manner to cross with the Address electrodes $A_1$ through $A_m$. Each region where an X electrode and a Y electrode cross with an Address electrode corresponds to a discharge cell. Each X electrode $X_1$ through $X_n$ can be formed of a transparent electrode $X_{na}$ made of a transparent conductive material such as ITO (Indium Tin Oxide), and a metal electrode $X_{nb}$ for increasing conductivity. Similarly, each Y electrode $Y_1$ through $Y_n$ can be formed of a transparent electrode $Y_{na}$ made of a transparent conductive material such as ITO, and a metal electrode $Y_{nb}$ for increasing conductivity. The first dielectric layer 102 covers the X electrodes $X_1$ through $X_n$ and the Y electrodes $Y_1$ through $Y_n$. The protection layer 104, including for example MgO, for protecting the PDP from a strong field is formed to cover the entire surface of the first dielectric layer 102. A plasma forming gas is filled in a discharge space 108.

The PDP driven by the PDP driving apparatus according to the present invention is not limited to that shown in FIG. 1.

Figure 2:
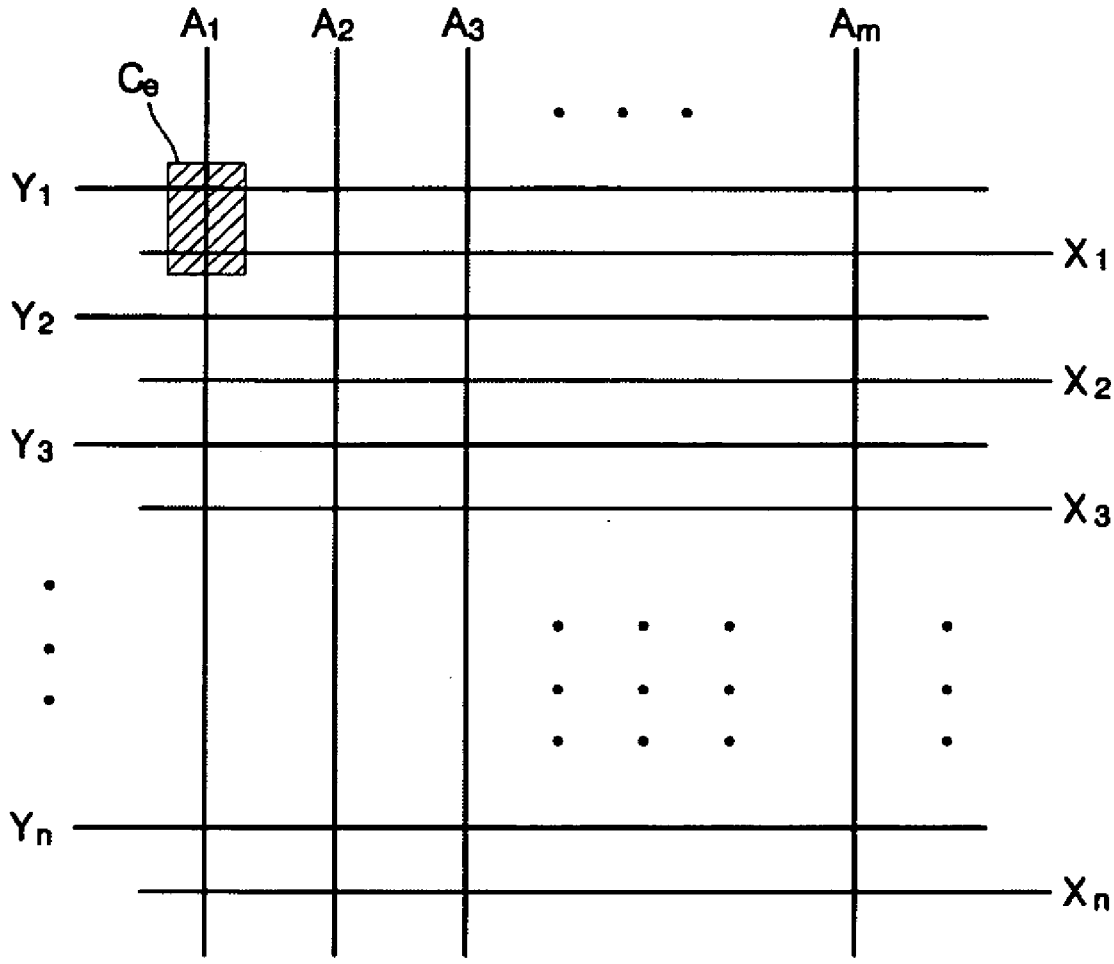
FIG. 2 shows a schematic view of an electrode arrangement of the PDP shown in FIG. 1.

FIG. 2 shows a schematic view of an electrode arrangement of the PDP shown in FIG. 1.

Referring to FIG. 2, the Y electrodes $Y_1$ through $Y_n$ and X electrodes $X_1$ through $X_n$ are arranged parallel to each other, and the Address electrodes $A_1$ through $A_m$ are arranged to cross with the Y electrodes $Y_1$ through $Y_n$ and X electrodes $X_1$ through $X_n$. Each region where an X electrode and a Y electrode cross with an Address electrode corresponds to a discharge cell Ce.

Figure 3:
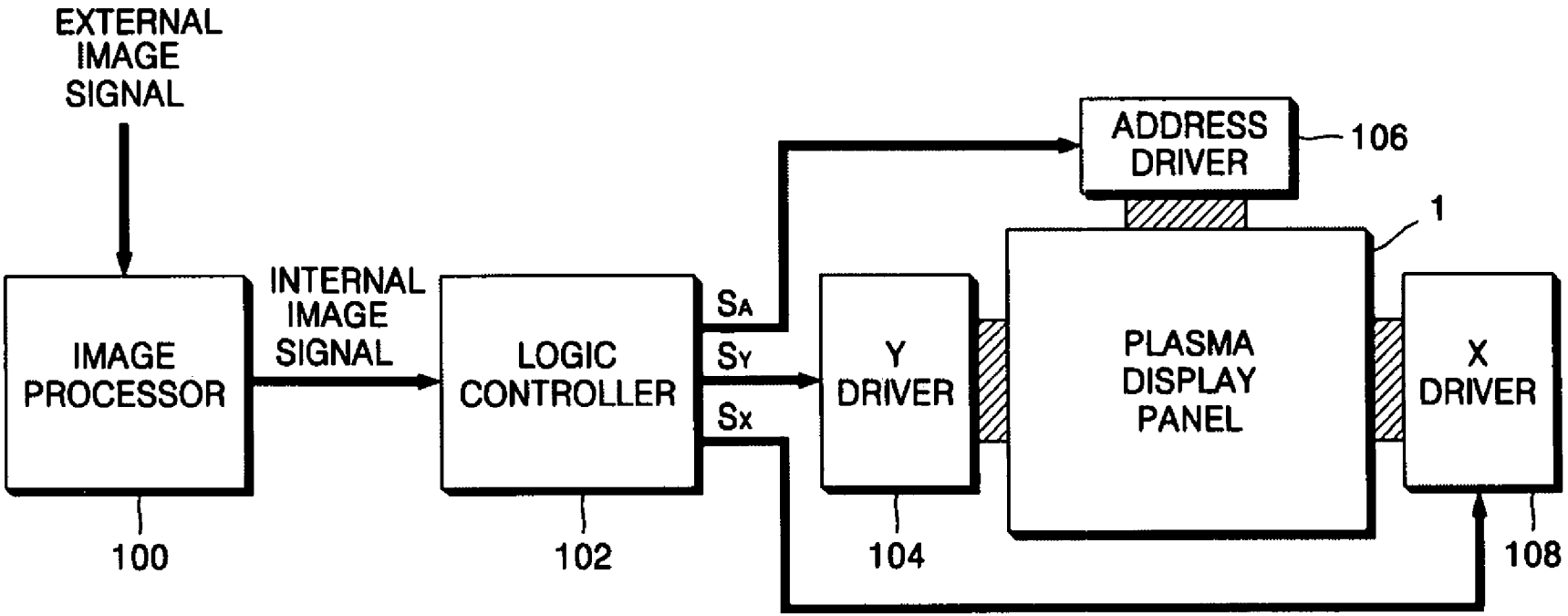
FIG. 3 shows a block diagram of a PDP driving apparatus for driving the PDP shown in FIG. 1.

FIG. 3 shows a block diagram of a PDP driving apparatus for driving the PDP shown in FIG. 1.

Referring to FIG. 3, the PDP driving apparatus includes an image processor 100, a is logic controller 102, a Y driver 104, an address driver 106, an X driver 108, and a PDP 1. The image processor 100 receives an external image signal, converts the external image signal into an internal image signal, and transmits the internal image signal. The logic controller 102 receives the internal image signal and outputs an address driving control signal $S_A$, a Y driving control signal $S_Y$, and an X driving control signal $S_X$. The Y driver 104 receives the Y driving control signal $S_Y$, and outputs the received Y driving control signal $S_Y$ to the Y electrodes. The address driver 106 receives the address driving control signal $S_A$, and outputs the received address driving control signal $S_A$ to the Address electrodes. The X driver 108 receives the X driving control signal $S_X$, and outputs the received X driving control signal $S_X$ to the X electrodes.

Figure 4:
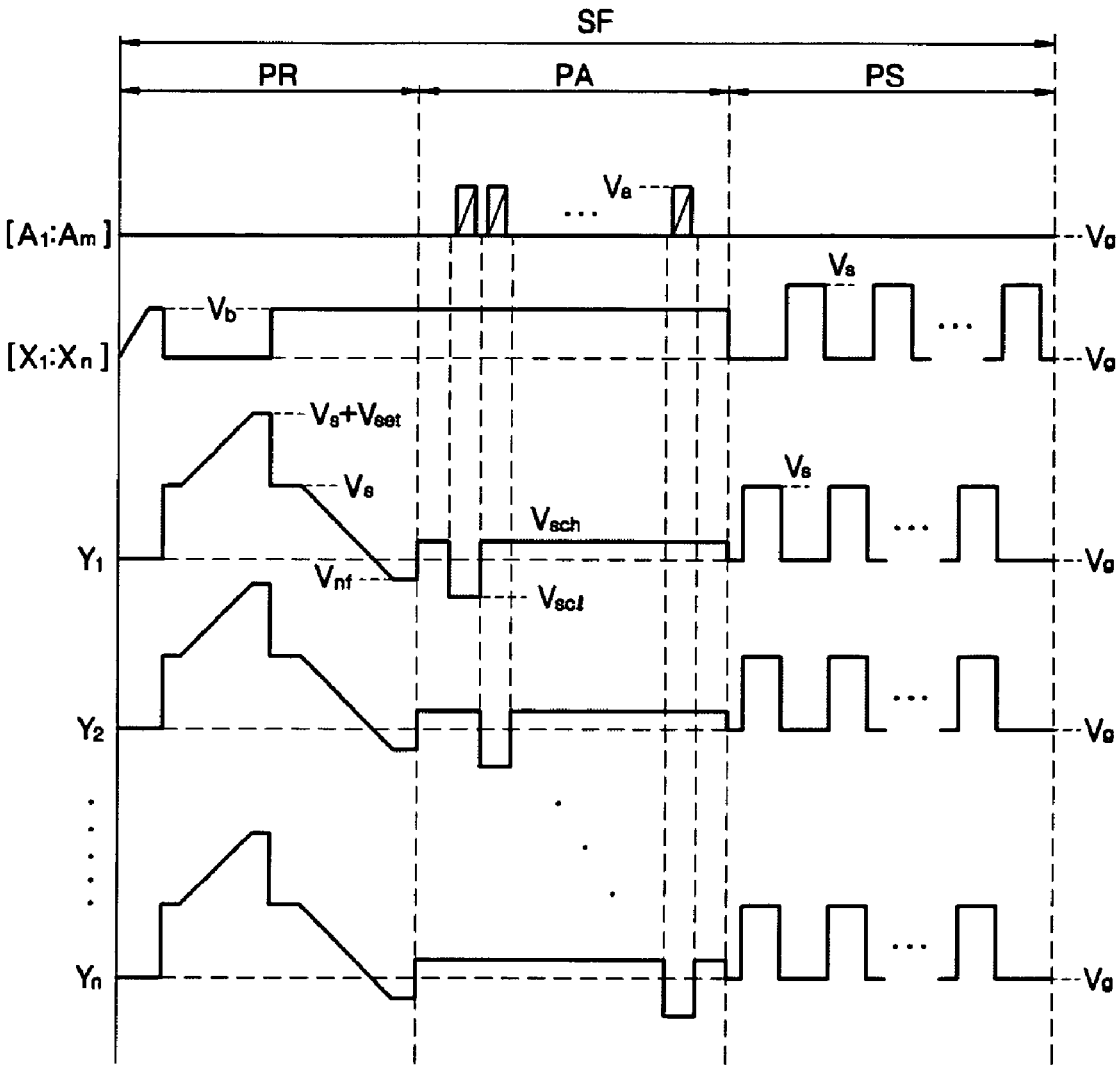
FIG. 4 shows timing diagrams for explaining driving signals output from respective drivers shown in FIG. 3.

FIG. 4 shows timing diagrams for explaining driving signals output from respective drivers shown in FIG. 3.

Referring to FIG. 4, a unit frame for driving a PDP 1, such as the PDP shown in FIG. 1, is divided into a plurality of subfields, and each subfield SF is divided into a reset period PR, an address period PA, and a sustain period PS.

In the reset period PR, a reset pulse consisting of a rising ramp and a falling ramp is simultaneously applied to Y electrodes $Y_1$ through $Y_n$, and a voltage $V_b$ is applied to X electrodes $X_1$ through $X_n$ from when a falling pulse is applied, to generate a reset discharge. All discharge cells in the PDP 1 are initialized by the reset discharge. The rising ramp gradually increases from a first voltage $V_s$, by a third voltage $V_{set}$, to a maximum voltage $V_{set}+V_s$, and the falling ramp decreases from the first voltage $V_s$ to a fourth voltage $V_{nf}$.

In the address period PA, a scan pulse is sequentially applied to the Y electrodes $Y_1$ through $Y_n$ to be selected and a display data signal is applied to the Address electrodes $A_1$ through $A_m$ in synchronization with each scan pulse, to thus generate an address discharge in the selected cells to be turned on. Specifically, the address discharge is generated to select discharge cells to be sustain-discharged in the following sustain period PS. The scan pulse includes a fifth voltage $V_{sch}$ and a sixth voltage $V_{sc1}$ lower than the fifth voltage $V_{sch}$. The display data signal has a positive address voltage $V_a$, applied to an Address electrode $A_1$ through $A_m$ when the scan pulse with the sixth voltage $V_{sc1}$ is applied to a Y electrode corresponding to the Address electrode.

In the sustain period PS, a sustain pulse is simultaneously applied to the X electrodes $X_1$ through $X_n$ and the Y electrodes $Y_1$ through $Y_n$, to thus generate a sustain discharge in the discharge cells selected during address period PA. The sustain pulse alternates between the voltage $V_s$ and a ground voltage $V_g$. When voltage $V_s$ is applied to the X electrodes $X_1$ through $X_n$, ground voltage $V_g$ is applied to Y electrodes $Y_1$ through $Y_n$. Alternately, when ground voltage $V_g$ is applied to the X electrodes $X_1$ through $X_n$, voltage $V_s$ is applied to Y electrodes $Y_1$ through $Y_n$. Brightness is represented according to a gray-level weight assigned to each subfield by the sustain discharge.

It is possible that driving signals different from those shown in FIG. 4 are output from the respective drivers shown in FIG. 3, and the invention is not limited to the driving signals illustrated in FIG. 4.

Figure 5:
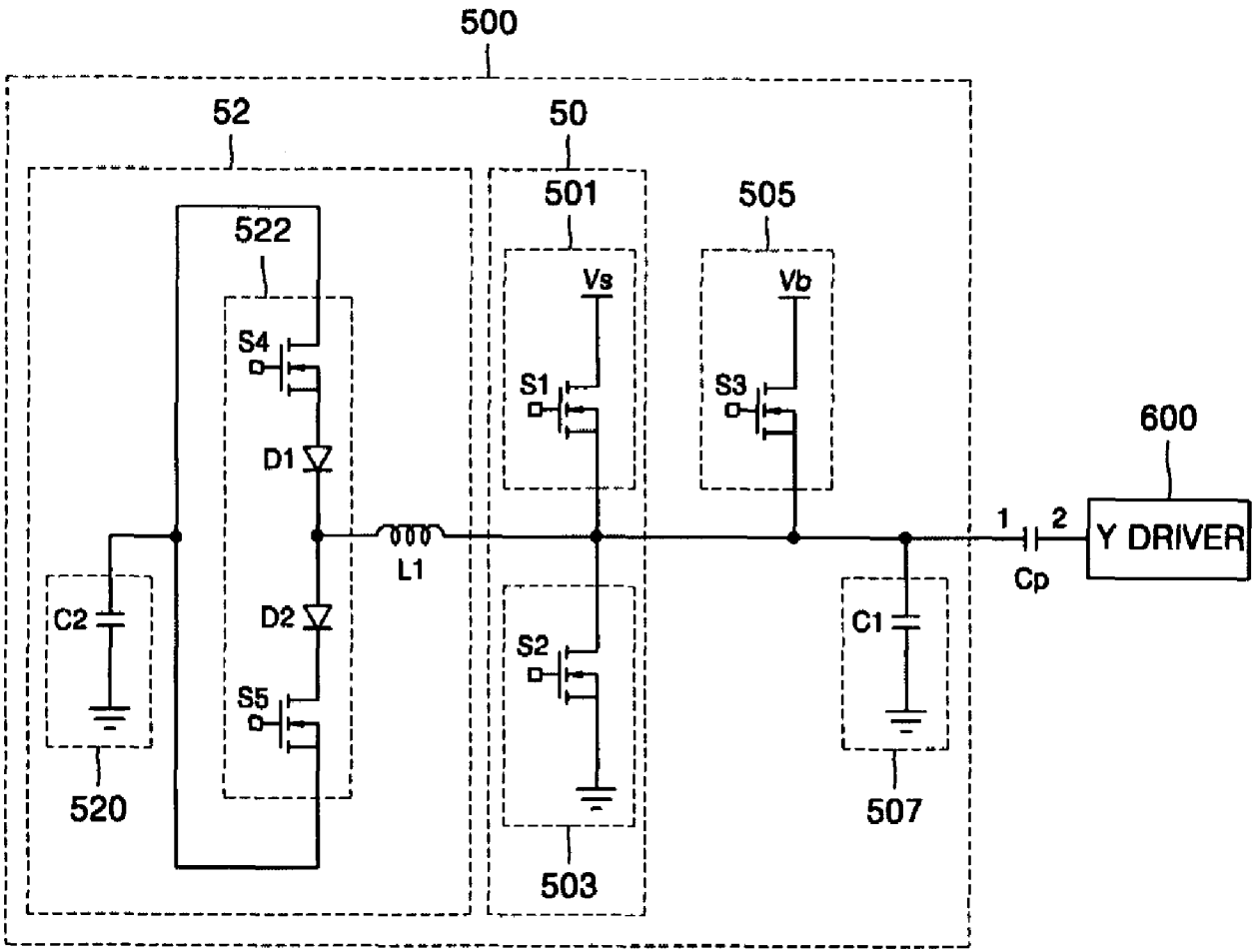
FIG. 5 shows a circuit diagram of an X driver of a PDP driving apparatus according to an exemplary embodiment of the present invention.

FIG. 5 shows a circuit diagram of an X driver of a PDP driving apparatus according to an exemplary embodiment of the present invention.

Referring to FIG. 4 and FIG. 5, to output a driving signal to an X electrode, shown as the first terminal of a capacitor Cp, the PDP driving apparatus includes a sustain pulse applying unit 50 including a first voltage applying unit 501 for outputting a first voltage $V_s$ and a ground voltage applying unit 503 for outputting a ground voltage $V_g$; a second voltage applying unit 505 for outputting a second voltage $V_b$; an energy recovery unit 52 for storing charges in a capacitor C2 or emitting the stored charges of the capacitor C2; and a frequency lowering unit 507 for lowering a resonance frequency caused by parasitic capacitance and inductance components of the sustain pulse applying unit 50, the second voltage applying unit 505, and the energy recovery unit 52.

The first voltage applying unit 501 includes a first switching device S1 with one terminal coupled with the first voltage source $V_s$ and the other terminal coupled with the X electrode, i.e. the first terminal of the capacitor Cp, of the PDP. The ground voltage applying unit 503 includes a second switching device S2 having one terminal coupled with a ground terminal and the other terminal coupled with the X electrode of the PDP. In the sustain pulse applying unit 50, including the first voltage applying unit 501 and the ground voltage applying unit 503, the first switching device S1 and the second switching device S2 are alternately turned on and off to alternately supply voltage $V_s$ and ground voltage $V_g$ to the X electrode, thus forming a sustain pulse.

The second voltage applying unit 505 includes a third switching device S3 having one terminal coupled with the second voltage source $V_b$ and the other terminal coupled with the X electrode. The third switching device S3 is turned on to output the second voltage $V_b$ to the X electrode.

The energy recovery unit 52 includes an energy storage unit 520 for storing charges from the capacitor Cp; an energy recovery switching unit 522 coupled with the energy storage unit 520 and performing switching operations for transferring charges stored in the energy storage unit 520 to the capacitor Cp, or storing the charges from the capacitor Cp in the energy storage unit 520; and an inductor L1 having a first terminal coupled with the energy recovery switching unit 522 and a second terminal coupled with the X electrode.

The energy storage unit 520 can include a capacitor C2 for storing charges from the capacitor Cp.

The energy recovery switching unit 522 includes a fourth switching device S4 and a fifth switching device S5, each having one terminal coupled with the energy storage unit 520 and the other terminal coupled with the inductor L1. First diode D1 can be coupled with the fourth switching device S4, and second diode D2 can be coupled with the fifth switching device S5.

In the energy recovery unit 52, when the fifth switching device S5 is turned on and the fourth switching device S4 is turned off, the charges in the capacitor Cp are transferred to the second capacitor C2 via the inductor L1, the second diode D2, and the fifth switching device S5. When the fourth switching device S4 is turned on and the fifth switching device S5 is turned off, the charges stored in the second capacitor C2 are transferred to the capacitor Cp via the fourth switching device S4, the first diode D1, and the inductor L1.

The frequency lowering unit 507 is coupled between the X electrode and the ground terminal, and includes a first capacitor C1. The first, second, third, fourth, and fifth switching devices S1, S2, S3, S4, and S5 may be field effect transistors (FETs), as shown in FIG. 5. Each FET has a parasitic capacitance between its drain and source, and wires coupled with each FET have inductance components. Accordingly, each of the first diode D1 and second diode D2 of the energy recovery switching unit 522 has a parasitic capacitance between its anode and cathode, and wires coupled with the first diode D1 or second diode D2 have inductance components. Also, LC-resonance is generated due to the parasitic capacitance and inductance components of the first diode D1 and second diode D2, and the first, second, third, fourth, and fifth switching devices S1, S2, S3, S4, and S5 of the sustain pulse applying unit 50, the second voltage applying unit 505, and the energy recovery unit 52. The LC-resonance generates the electromagnetic wave as described above. In the present exemplary embodiment, since the total capacitance of the PDP driving apparatus increases due to the first capacitor C1 of the frequency lowering unit 507, the resonance frequency can be reduced and generation of undesired electromagnetic waves may be prevented. However, if the capacitance of the first capacitor C1 is excessively large, waveforms output to the X electrode may be distorted or the heat generated by the switching devices may increase. Therefore, the capacitance of the first capacitor Cp may be between about 1 nF and about 2 nF.

Figure 6:
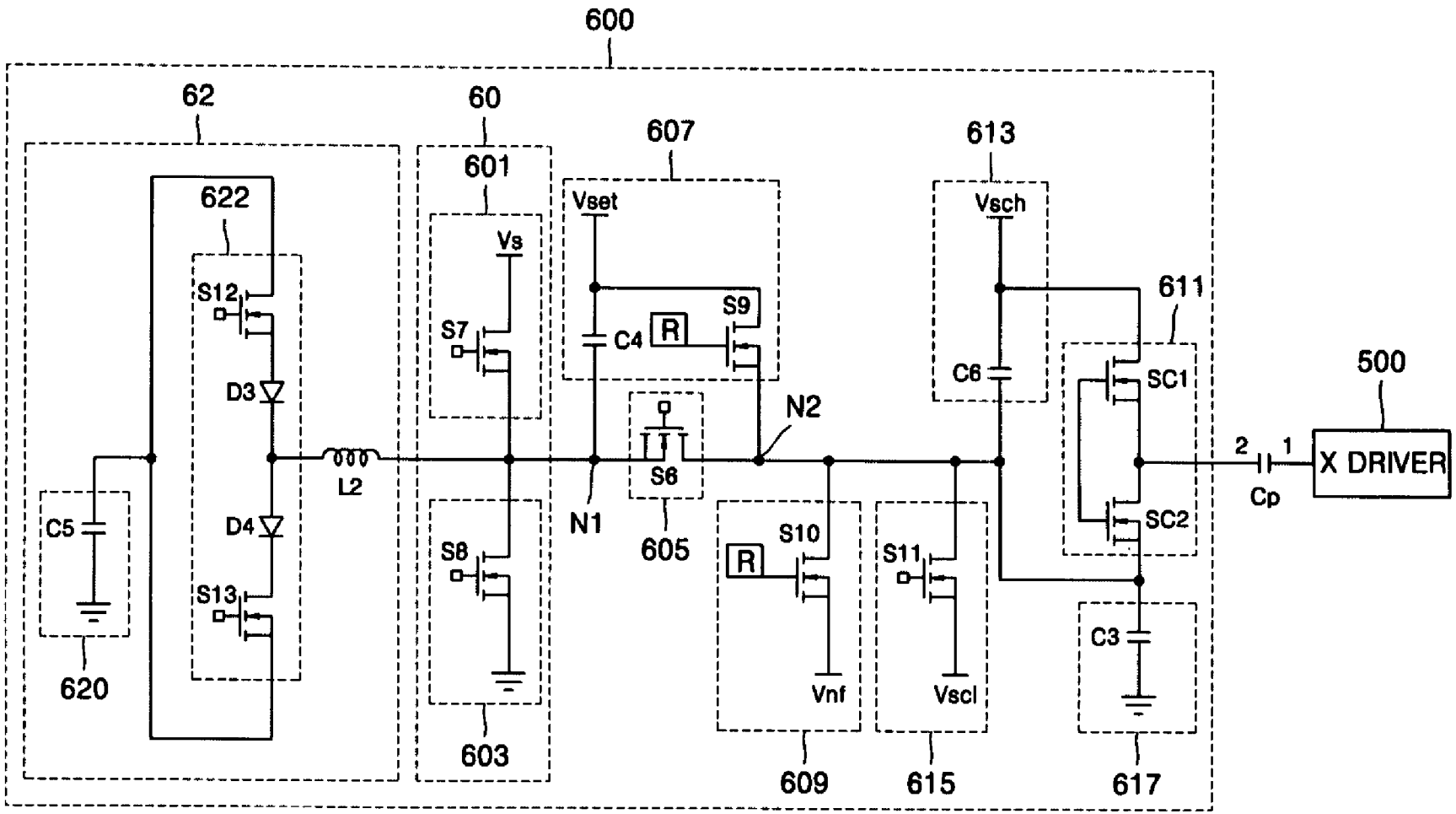
FIG. 6 shows a circuit diagram of a Y driver of a PDP driving apparatus according to another exemplary embodiment of the present invention.

FIG. 6 shows a circuit diagram of a Y driver of a PDP driving apparatus according to another exemplary embodiment of the present invention.

Referring to FIG. 4 and FIG. 6, to output a driving signal to a Y electrode, shown as the second terminal of the capacitor Cp, the PDP driving apparatus includes a sustain pulse applying unit 60 including a first voltage applying unit 601 for outputting a first voltage $V_s$ to a first node N1 and a ground voltage applying unit 603 for outputting a ground voltage to the first node N1; a first switching unit 605 including a sixth switching device S6 having one terminal coupled with the first node N1 and the other terminal coupled with a second node N2; a third voltage applying unit 607 coupled between the first node N1 and the second node N2 and gradually raising the first voltage $V_s$ by a third voltage $V_{set}$ and outputting the third voltage $V_{set}$ to the second node N2; a fourth voltage applying unit 609 connected to the second node N2 and gradually lowering the first voltage $V_s$ to a fourth voltage $V_{nf}$ and outputting the fourth voltage $V_{nf}$ to the second node N2; a scan switching unit 611 including a first scan switching device SC1 and a second scan switching device SC2 connected in series to each other, wherein a common node of the first scan switching device SC1 and second scan switching device SC2 is coupled with the Y electrode; a fifth voltage applying unit 613 including a fifth voltage source $V_{sch}$ and coupled with the first scan switching device SC1, for outputting the fifth voltage $V_{sch}$ to the first scan switching device SC1; a sixth voltage applying unit 615 coupled with the second node N2 and the second scan switching device SC2 and outputting a sixth voltage $V_{sc1}$; an energy recovery unit 62 for transferring charges to the capacitor Cp or storing charges from the capacitor Cp; and a frequency lowering unit 617 coupled between the second scan switching device SC2 and a ground terminal and lowering a resonance frequency caused by parasitic capacitance and inductance components of the sustain pulse applying unit 601, the first switching unit 605, the third voltage applying unit 607, the scan switching unit 611, the fourth voltage applying unit 609, the fifth voltage applying unit 613, and the sixth voltage applying unit 615.

The first voltage applying unit 601 includes a seventh switching device S7 having one terminal coupled with the first voltage source $V_s$ and the other terminal coupled with the first node N1. The ground voltage applying unit 603 includes an eighth switching device S8 having one terminal coupled with the ground terminal and the other terminal coupled with the first node N1. In the sustain pulse applying unit 60 including the first voltage applying unit 601 and the ground voltage applying unit 603, the seventh switching device S7 and the eighth switching device S8 are alternately turned on and off to alternately supply voltage $V_s$ and ground voltage $V_g$ to the Y electrode, thus forming a sustain pulse.

The third voltage applying unit 607 includes a fourth capacitor C4 having one terminal coupled with the first node N1 and the other terminal coupled with the third voltage source $V_{set}$, and a ninth switching device S9 coupled between the third voltage source $V_{set}$ and the second node N2. When the sixth switching device S6 is turned off, and the seventh switching device S7 and the ninth switching device S9 are turned on, a pulse with a voltage gradually increasing from the first voltage $V_s$ by the third voltage $V_{set}$ to the maximum voltage $V_s+V_{set}$ is output to the second node N2.

The fourth voltage applying unit 609 includes a tenth switching device S10 having one terminal coupled with the second node N2 and the other terminal coupled with the fourth voltage source $V_{nf}$. When the seventh switching device S7, the sixth switching device S6, and the tenth switching device S10 are turned on, a pulse with a voltage gradually decreasing from the first voltage $V_s$ to the fourth voltage $V_{nf}$ is output to the second node N2.

The sixth voltage applying unit 615 includes an eleventh switching device S11 coupled between the second node N2 and the sixth voltage source $V_{sc1}$. The eleventh switching device S11 is turned on to output the sixth voltage $V_{sc1}$ to the second node N2.

When the first scan switching device SC1 is turned on and the second scan switching device SC2 is turned off, the fifth voltage $V_{sch}$ is output to the Y electrode. Conversely, when the first scan switching device SC1 is turned off and the second scan switching device SC2 is turned on, the voltages output to the second node N2, including the first voltage $V_s$, the ground voltage $V_g$, the maximum voltage $V_s+V_{set}$, the fourth voltage $V_{nf}$, or the sixth voltage $V_{sc1}$, can be output to the Y electrode.

The energy recovery unit 62 includes the energy storage unit 620 for storing charges from the capacitor Cp; an energy recovery switching unit 622 coupled with the energy storage unit 620 and performing switching operations for transferring charges stored in the energy storage unit 620 to the capacitor Cp, or storing charges from the capacitor Cp in the energy storage unit 620; and an inductor L2 having a first terminal coupled with the energy recovery switching unit 622 and a second terminal coupled with the first node N1.

The energy storage unit 620 can include a fifth capacitor C5 for storing charges from the capacitor Cp.

The energy recovery switching unit 622 includes a twelfth switching device S12 and a thirteenth switching device S13, each having one terminal coupled with the energy storage unit 620 and the other terminal coupled with the inductor L2. Third diode D3 can be coupled with the twelfth switching device S12, and fourth diode D4 can be coupled with the thirteenth switching device S13.

The gate terminals of the ninth switching device S9 and the tenth switching device S10 are coupled with circuit R for controlling the slope of the increasing or decreasing ramp voltage during the reset period PR. Circuit R may include a capacitor arranged between a gate and a drain of a field-effect transistor (FET) to generate a ramp pulse. To completely turn on the FET, a parasitic capacitance Cgs between the gate and the source of the FET, and a parasitic capacitance Cgd between the gate and the drain of the FET are charged. Thus, by adding the capacitance of the capacitor to the parasitic capacitance Cgd to charge the parasitic capacitance Cgs, a period of time from when the FET having a voltage greater than a threshold voltage starts to turn on to when the FET is completely turned on can be extended. This allows the FET to provide increasing or decreasing ramp voltage. Accordingly, the parasitic capacitance Cgs is charged to turn the FET partially on and provide increasing ramp voltage. Then, the charged parasitic capacitance Cgs is discharged to turn the FET partially off and provide decreasing ramp voltage.

Additionally, circuit R may include a resistor to provide a constant current to the panel while the FET is partially on or partially off. When the gate current charges the parasitic capacitance Cgs to open the FET, a current Id starts flowing through the FET. The current Id charges the parasitic capacitance Cgd and increases, but the increase of current Id generates a voltage drop across the resistor. The voltage drop across the resistor reduces the voltage charged to the parasitic capacitance Cgs. When the voltage charged to parasitic capacitance Cgs decreases, the FET closes the channel and current Id is reduced. As the current Id decreases, the voltage drop across the resistor and the voltage charged to parasitic capacitance Cgs decrease, and the FET opens the channel to again increase current Id. This operation repeats cyclically, and is a negative feedback effect that allows the FET to operate as a constant current source.

For explaining the operation of the energy recovery unit 62, it is assumed that the sixth switching device S6 and the second scan switching device SC2 are turned on. If the thirteenth switching device S13 is turned on and the twelfth switching device S12 is turned off, charges from the capacitor Op are transferred to and stored in the fifth capacitor 05 via the inductor L2, the fourth diode D4, and the thirteenth switching device S13. If the twelfth switching device S12 is turned on and the thirteenth switching device S13 is turned off, charges stored in the fifth capacitor C5 are transferred to and stored in the capacitor Cp via the twelfth switching device S12, the third diode D3, and the inductor L2.

The frequency lowering unit 617 is coupled between the second scan switching device SC2 of the scan switching unit 611 and the ground terminal, and includes a third capacitor C3. Meanwhile, the sixth, seventh, eighth, ninth, tenth, eleventh, twelfth, and thirteenth switching devices S6, S7, S8, S9, S10, S11, S12, and S13 may be field effect transistors FETs, as shown in FIG. 6. Each FET has a parasitic capacitance between its drain and source, and wires coupled with each FET have inductance components. Also, each of the third diode D3 and the fourth diode D4 of the energy recovery switching unit 622 has a parasitic capacitance between its anode and cathode, and wires coupled with the third diode D3 or the fourth diode D4 have inductance components. Accordingly, LC-resonance is generated due to the parasitic capacitance and inductance components of the sixth, seventh, eighth, ninth, tenth, eleventh, twelfth, and thirteenth switching devices S6, S7, S8, S9, S10, S11, S12, and S13, and the third diode D3 and the fourth diode D4 of the sustain pulse applying unit 60, the first switching unit 605, the third voltage applying unit 607, the scan switching unit 611, the fourth voltage applying unit 609, the fifth voltage applying unit 613, the sixth voltage applying unit 615, and the energy recovery 62. The LC-resonance generates the electromagnetic wave as described above.

In the present exemplary embodiment, since the total capacitance of the PDP driving apparatus increases due to the third capacitor C3 of the frequency lowering unit 617, the resonance frequency can be reduced and generation of the undesired electromagnetic waves may be prevented. However, if the capacitance of the third capacitor C3 is excessively large, the waveforms output to the Y electrode may be distorted or the heat generated by the switching devices may increase. Therefore, the capacitance of the third capacitor C3 may be between about 1 nF and about 2 nF.

As described above, according to the present invention, the following effects may be obtained.

First, according to a PDP driving apparatus of the present invention, resonance frequency caused by parasitic capacitance and inductance components of the PDP driving apparatus may be lowered by using a frequency lowering unit.

Second, since the frequency lowering unit can be disposed between a PDP and a ground terminal, a simple implementation is possible and a cost reduction may result.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. An apparatus for driving a plasma display panel (PDP), the PDP including a plurality of X electrodes and a plurality of Y electrodes arranged parallel to each other and a plurality of Address electrodes arranged to cross with the plurality of X electrodes and the plurality of Y electrodes to define discharge cells, comprising:

a sustain pulse applying unit including a first voltage applying unit to output a first voltage to one X electrode of the plurality of X electrodes and a ground voltage applying unit to output a ground voltage to the X electrode;

a second voltage applying unit to output a second voltage to the X electrode;

a frequency lowering unit coupled between the X electrode and a ground terminal, the frequency lowering unit to lower a resonance frequency caused by parasitic capacitance and inductance components of the sustain pulse applying unit and the second voltage applying unit; and an energy recovery unit coupled with the X electrode, the energy recovery unit to transfer charges to the PDP or to store charges from the PDP, wherein the frequency lowering unit also lowers a resonance frequency caused by parasitic capacitance and inductance components of the energy recovery unit, wherein the energy recovery unit comprises:

an energy storage unit to store the charges from the PDP;

an energy recovery switching unit coupled with the energy storage unit, the energy recovery switching unit to transfer the charges from the energy storage unit to the PDP or from the PDP to the energy storage unit; and an inductor having a first terminal coupled with the energy recovery switching unit and a second terminal coupled with the X electrode, and wherein the energy recovery switching unit comprises:

a first switching device having a first terminal coupled with the energy storage unit, and a second terminal coupled with the inductor; and a second switching device having a first terminal coupled with the energy storage unit, and a second terminal coupled with the inductor, whereby the first switching device is turned on to store the charges from the PDP in the energy storage unit, and the second switching device is turned on to transfer the charges stored in the energy storage unit to the PDP.

2. The apparatus of claim 1, wherein the energy storage unit comprises a capacitor.

3. An apparatus for driving a plasma display panel (PDP), the PDP including a plurality of X electrodes and a plurality of Y electrodes arranged parallel to each other and a plurality of Address electrodes arranged to cross with the plurality of X electrodes and the plurality of Y electrodes to define discharge cells, comprising:

a sustain pulse applying unit including a first voltage applying unit to output a first voltage to a first node and a ground voltage applying unit to output a ground voltage to the first node;

a first switching unit coupled between the first node and a second node and including a first switching device;

a second voltage applying unit to gradually increase the first voltage by a second voltage and to output the second voltage to the second node;

a third voltage applying unit to gradually decrease the first voltage to a third voltage and to output the third voltage to the second node;

a scan switching unit including a first scan switching device and a second scan switching device coupled in series with each other, wherein one Y electrode of the plurality of Y electrodes is coupled between the first scan switching device and the second switching device;

a fourth voltage applying unit coupled with the first scan switching device and to output a fourth voltage;

a fifth voltage applying unit coupled between the second node and the second scan switching device and to output a fifth voltage; and a frequency lowering unit coupled between the second scan switching device and a ground terminal, the frequency lowering unit to lower a resonance frequency caused by parasitic capacitance and inductance components of the sustain pulse applying unit, the first switching unit, the scan switching unit, the third voltage applying unit, the fourth voltage applying unit, the fifth voltage applying unit, and the second voltage applying unit.

4. The apparatus of claim 3, wherein the frequency lowering unit comprises a capacitor.

5. The apparatus of claim 4, wherein a capacitance of the capacitor is between about 1 nF and about 2 nF.

6. The apparatus of claim 3, wherein the first voltage applying unit comprises:

a second switching device having a first terminal coupled with a first voltage source and a second terminal coupled with the first node, the ground voltage applying unit comprises:

a third switching device having a first terminal coupled with the ground terminal and a second terminal coupled with the first node, wherein the second switching device and the third switching device are alternately turned on to apply a sustain pulse to the first node.

7. The apparatus of claim 6, wherein the second voltage applying unit comprises:

a capacitor having a first terminal coupled with the first node and a second terminal coupled with a second voltage source;

a fourth switching device coupled between the second voltage source and the second node, wherein the first switching device is turned off and the second switching device and the fourth switching device are turned on to gradually increase the first voltage by the second voltage and to output a summed voltage to the second node.

8. The apparatus of claim 6, wherein the third voltage applying unit comprises:

a fourth switching device having a first terminal coupled with the second node and a second terminal coupled with a second voltage source, wherein the first switching device, the second switching device, and the fourth switching device are turned on to gradually decrease the first voltage to the third voltage and to output the third voltage to the second node.

9. The apparatus of claim 3, wherein the fifth voltage applying unit comprises:

a second switching device coupled between the second node and a first voltage source, wherein the second switching device is turned on to output the fifth voltage to the second node.

10. The apparatus of claim 3, wherein the first scan switching device is turned on and the second scan switching device is turned off to output the fourth voltage to the Y electrode, and the first scan switching device is turned off and the second scan switching device is turned on to output a voltage at the second node to the Y electrode.

11. The apparatus of claim 3, further comprising:

an energy recovery unit coupled with the Y electrode, the energy recovery unit to transfer charges to the PDP or to store charges from the PDP, wherein the frequency lowering unit also lowers a resonance frequency caused by parasitic capacitance and inductance components of the energy recovery unit.

12. The apparatus of claim 11, wherein the energy recovery unit includes:

an energy storage unit to store the charges from the PDP;

an energy recovery switching unit coupled with the energy storage unit, the energy recovery switching unit to transfer the charges from the energy storage unit to the PDP or from the PDP to the energy storage unit; and an inductor having a first terminal coupled with the energy recovery switching unit and a second terminal coupled with the Y electrode.

13. The apparatus of claim 12, wherein the energy recovery switching unit comprises:

a second switching device having a first terminal coupled with the energy storage unit and a second terminal coupled with the inductor;

a third switching device having a first terminal coupled with the energy storage unit and a second terminal coupled with the inductor, wherein the second switching device is turned on to store the charges from the PDP in the energy storage unit, and the third switching device is turned on to transfer the charges stored in the energy storage unit to the PDP.

14. The apparatus of claim 13, wherein the energy storage unit comprises a capacitor.

* * * * *